United States Patent [19]

Ishii et al.

[11] Patent Number: 4,751,502

[45] Date of Patent: Jun. 14, 1988

[54] DISPLAY CONTROLLER FOR DISPLAYING A CURSOR ON EITHER OF A CRT DISPLAY DEVICE OR A LIQUID CRYSTAL DISPLAY DEVICE

[75] Inventors: Takatoshi Ishii, Tokyo; Makoto Kaneko, Hamamatsu, both of Japan

[73] Assignees: Ascii Corporation, Tokyo; Nippon Gakki Seizo Kabushiki Kaisha, Hamamatsu, both of Japan

[21] Appl. No.: 844,159

[22] Filed: Mar. 26, 1986

[30] Foreign Application Priority Data

Mar. 27, 1985 [JP] Japan ..... 60-62861

[51] Int. Cl.[4] ..... G09G 1/00

[52] U.S. Cl. ..... 340/709; 340/706; 340/716; 340/720; 340/723; 340/784

[58] Field of Search ..... 340/706, 709, 716, 717, 340/720, 723, 765, 784; 350/331 R, 332, 333

[56] References Cited

U.S. PATENT DOCUMENTS

| | | | |
|---|---|---|---|
| 4,112,423 | 9/1978 | Bertolasi | 340/717 |
| 4,201,983 | 5/1980 | Magerl et al. | 340/709 |
| 4,323,891 | 4/1982 | Akashi | 340/709 |
| 4,354,184 | 10/1982 | Woborschill | 340/709 |
| 4,365,242 | 12/1982 | Yasuda et al. | 340/709 |
| 4,536,856 | 8/1985 | Hiroishi | 364/900 |

*Primary Examiner*—Gerald L. Brigance
*Assistant Examiner*—Jeffery A. Brier
*Attorney, Agent, or Firm*—Cushman, Darby & Cushman

[57] ABSTRACT

A display controller which can display a cursor on either of a CRT display or a liquid crystal type display device is described. The liquid crystal type display device is a type that has an upper and lower display blocks which are scanned substantially in parallel. This display controller allows the display position of the cursor to be designated in the same manner, independent of the type of display device used. The display controller operates in a time sharing manner, alternately on the upper and lower display blocks of the liquid crystal device. Two groups of data corresponding to these upper and lower blocks are formed and are supplied to the liquid crystal display device substantially in parallel. X and Y coordinate positions of the cursor position are also stored. The cursor pattern signal for the liquid crystal display device is also stored in a time shared manner.

4 Claims, 8 Drawing Sheets

| Color Code | Color | RD | | | GD | | | BD | | |
|---|---|---|---|---|---|---|---|---|---|---|
| IRGB | Color | $R_2$ | $R_1$ | $R_0$ | $G_2$ | $G_1$ | $G_0$ | $B_2$ | $B_1$ | $B_0$ |
| 0000 | Black | 0 | 0 | 0 | 0 | 0 | 0 | 0 | 0 | 0 |
| 0001 | Blue | 0 | 0 | 0 | 0 | 0 | 0 | 1 | 0 | 0 |
| 0010 | Green | 0 | 0 | 0 | 1 | 0 | 0 | 0 | 0 | 0 |
| 0011 | Cyan | 0 | 0 | 0 | 1 | 0 | 0 | 1 | 0 | 0 |
| 0100 | Red | 0 | 1 | 1 | 0 | 0 | 0 | 0 | 0 | 0 |
| 0101 | Magenta | 1 | 0 | 0 | 0 | 0 | 0 | 1 | 0 | 0 |
| 0110 | Brown | 1 | 0 | 0 | 0 | 1 | 1 | 0 | 0 | 0 |
| 0111 | White | 1 | 0 | 0 | 1 | 0 | 0 | 1 | 0 | 0 |
| 1000 | Gray | 0 | 0 | 1 | 0 | 0 | 1 | 0 | 0 | 1 |
| 1001 | Light Blue | 0 | 0 | 0 | 0 | 0 | 0 | 1 | 1 | 0 |
| 1010 | Light Green | 0 | 0 | 0 | 1 | 1 | 0 | 0 | 0 | 0 |
| 1011 | Light Cyan | 0 | 0 | 0 | 1 | 1 | 0 | 1 | 1 | 0 |
| 1100 | Light Red | 1 | 0 | 1 | 0 | 0 | 0 | 0 | 0 | 0 |
| 1101 | Light Magenta | 1 | 1 | 0 | 0 | 0 | 0 | 1 | 1 | 0 |
| 1110 | Yellow | 1 | 1 | 0 | 1 | 1 | 0 | 0 | 0 | 0 |
| 1111 | White (High Intensity) | 1 | 1 | 1 | 1 | 1 | 1 | 1 | 1 | 1 |

FIG. 6

| DATA AV | DOTS ON SCREEN |
|---|---|
| 0 | 0TH TO 7TH DOTS |
| 0 | 8TH TO 15TH DOTS |
| ------ | ------ |
| 1 | 640TH TO 647TH DOTS |
| 1 | 648TH TO 655TH DOTS |
| ------ | ------ |
| 100 | 0TH TO 7TH DOTS |
| 100 | 8TH TO 15TH DOTS |
| ------ | ------ |
| 101 | 640TH TO 647TH DOTS |
| 101 | 648TH TO 655TH DOTS |
| ------ | ------ |

(a)

DISPLAY CONTROLLER FOR DISPLAYING A CURSOR ON EITHER OF A CRT DISPLAY DEVICE OR A LIQUID CRYSTAL DISPLAY DEVICE

BACKGROUND OF THE INVENTION

1. Field of the Invention

The present invention relates to a display controller for controlling a liquid crystal display device, a cathode-ray tube (hereinafter referred to as "CRT") display device or the like.

2. Prior Art

A display controller has been proposed which allows a display device such as a liquid crystal display device or a CRT display device to display various images under the control of a central processing unit (hereinafter referred to as "CPU"). Various types of display controllers have been developed and used for a variety of purposes.

In the case where a CRT display device is used as a display device, the display of an image on a screen thereof is conducted in an interlace or a non-interlace method, whereas, in the case of a dot-type liquid crystal display unit being used, the display screen is divided into upper half and lower half display blocks, and the display is conducted by simultaneously scanning both halves.

In either of the above cases, display of a cursor is conducted by, for example, storing dot-data representative of the cursor pattern in a video RAM, and changing the position of the dot-data in the video RAM in accordance with cursor position information. In another known cursor displaying method, a cursor signal is generated such that a cursor in the form of an underline is displayed immediately below the corresponding character displayed on the screen. The first-mentioned method is used mainly in a graphic display mode, while the second-mentioned method is used in a character display mode.

The first-mentioned method relying upon the changing of position of the dot-data in a video RAM, however, suffers from a problem that the CPU has to conduct complicated data processing in order to change the position of the dot-data, whereas, in the second-mentioned method making use of an underline, the shape and display position of the cursor are undesirably limited.

A display controller capable of controlling both of a CRT display device and a liquid crystal display device would be very helpful. However, such a display controller has not yet been developed, because both types of display devices use different scanning methods as explained before. Such a display controller adaptable to both types of display devices, even if such a device is available, would require different methods for designating coordinates of a cursor position for both display devices

SUMMARY OF THE INVENTION

Accordingly, an object of the invention is to provide a display controller which permits display of a cursor in any desired form and at any desired position on the screen, without burdening the CPU.

Another object of the invention is to provide a display controller which can cause a cursor to be displayed on a screen of either of a CRT display device and a multi-display block type liquid crystal display device, while enabling designation of coordinates of the cursor position in the same method both for the CRT display device and the liquid crystal display device.

According to an aspect of the present invention, there is provided a display controller for use with a display device having a plurality of scanning-type display screens arranged in the direction perpendicular to the directions of scanning thereof to form a single screen for providing a plurality of display dots thereon, the display controller effecting scannings of the plurality of screens of the display device in parallel, the display controller comprising clock signal generating means for generating a clock signal synchronized with the scannings of the plurality of display screens; display screen designating means for designating, in a time-sharing manner, one of the plurality of display screens in accordance with the clock signal to output a data forming timing signal indicative of one of the display screens; display data forming means responsive to the data forming timing signal and the clock signal for forming, in a time-sharing manner, display data each representing a dot image of a respective one of the plurality of display dots on the screen; data separating means for separating the display data formed by the display data forming means into a plurality of groups of data each corresponding to a respective one of the plurality of screens, the data separating means feeding the plurality of groups of data to the display device in parallel; pattern memory means for storing bit-pattern data representative of a cursor in the form of a dot-matrix; first and second register means for storing first position data representative of a horizontal position of a dot on the single display screen at which the cursor is to be displayed and second position data representative of a vertical position of the dot of the cursor on the single display screen, respectively; and cursor pattern signal forming means responsive to the clock signal, the data forming timing signal and the first and second position data for forming from the bit-pattern data a cursor pattern signal in a time-sharing manner; the display data forming means forming the display data in accordance with the cursor pattern signal to thereby display the cursor on the single screen at a position determined by the horizontal and vertical positions.

According to another aspect of the present invention, there is provided a display controller for use with either of a first display device having a single scanning-type display screen for providing a plurality of display dots thereon and a second display device having a plurality of scanning-type display screens arranged in the direction perpendicular to the directions of scanning thereof to form a single screen for providing a plurality of display dots thereon, the display controller effecting scanning of the plurality of screens of the second display device in parallel, the display controller comprising display device designating means for designating one of the first and the second display devices, the display device designating means outputting a first designation signal when the first display device is designated and outputting a second designation signal when the second display device is designated; clock signal generating means for generating a first clock signal synchronized with the scanning of the display screen of the first display device in response to the first designation signal and for generating a second clock signal synchronized with the scannings of the plurality of display screens of the second display device in response to the second designation signal; display screen selecting means responsive to the second designation signal for selecting, in a time-sharing manner, each of the plurality of display screens in accordance with the second clock signal to output a data forming timing signal indicative of the each selected display screen; display data forming means responsive to the first designation signal for forming display data each representing a dot image of a respective one of the plurality of display dots provided on the screen of the first display device in accordance with the first clock signal, the display data forming means being responsive to the second designation signal to form, in a time-sharing manner, display data each representing a dot image of a respective one of the plurality of display dots provided on the screen of the second display device in accordance with the second clock signal and the data forming timing signal; data feeding means responsive to the first designation signal for feeding the display data to the first display device; data separating means responsive to the second designation signal for separating the display data formed by the display data forming means into a plurality of groups of data each corresponding to a respective one of the plurality of screens of the second display device and for feeding the plurality of groups of data to the second display device in parallel; pattern memory means for storing bit-pattern data representative of a cursor in the form of a dot-matrix; first and second register means for storing first position data representative of a horizontal display position of a dot of the cursor and second position data representative of a vertical display position of the dot of the cursor; and cursor pattern signal forming means responsive to the first designation signal, the first clock signal and the first and second position data for forming from the bit-pattern data a first cursor pattern signal in such a timing that the cursor is displayed on the screen of the first display device at a position determined by the first and second display positions, the cursor pattern signal forming means being responsive to the second designation signal, the second clock signal, the data forming timing signal and the first and second position data to form from the bit-pattern data a second cursor pattern signal in a time-sharing manner; the display data forming means forming the display data in accordance with the first cursor pattern signal in response to the first designation signal to thereby display the cursor on the screen of the first display device at the position determined by the horizontal and vertical display positions, the display data forming means forming the display data in accordance with the second cursor pattern signal in response to the second designation signal to thereby display the cursor on the screen of the second display device at the position determined by the horizontal and vertical display positions.

The above and other objects, features and advantages of the invention will become more apparent from the following description of the preferred embodiment when the same is read in conjunction with the accompanying drawings.

BRIEF DESCRIPTION OF THE DRAWINGS

FIG. 5-(*c*) is an illustration showing the cursor patterns PT1 and PT2 displayed on the screen;

FIG. 6 is a chart showing the relationship between the color codes and colors displayed in the embodiment shown in FIGS. 1 and 2;

DESCRIPTION OF THE PREFERRED EMBODIMENT OF THE INVENTION

One embodiment of the present invention will be described hereafter in detail with reference to the accompanying drawings.

Figure 1:
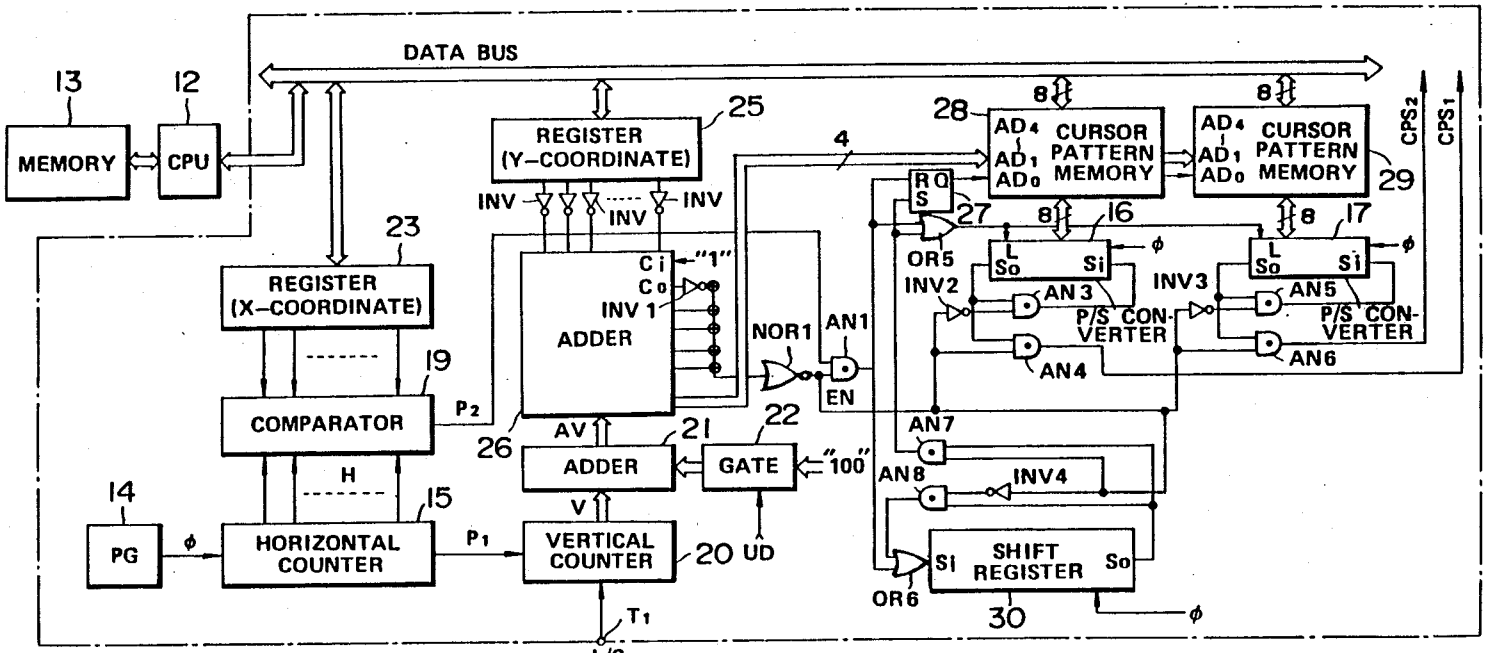
FIGS. 1 and 2 show a block diagram of an embodiment of the invention.
Figure 2:
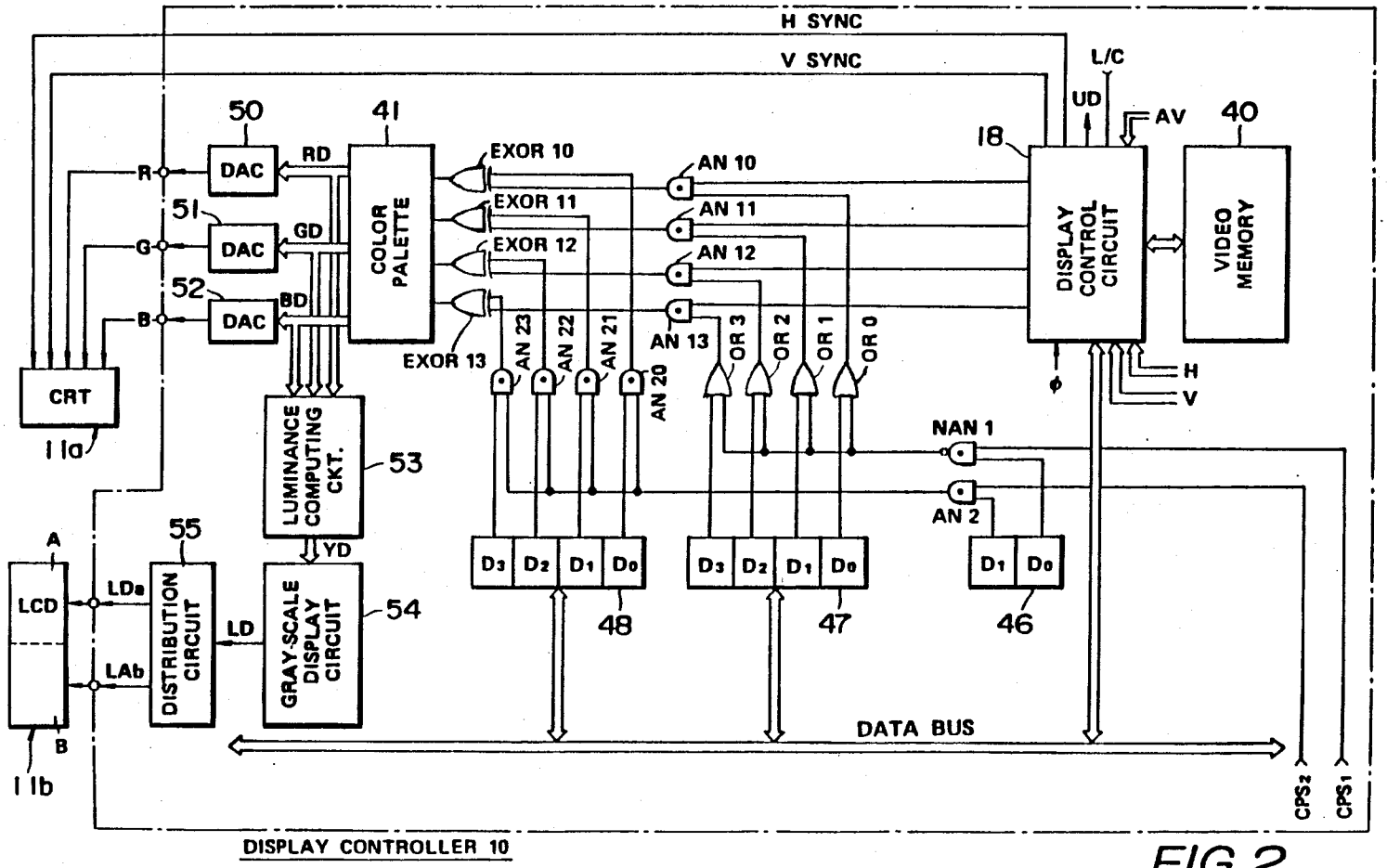

Referring now to FIGS. 1 and 2, a display controller 10 provided in accordance with one embodiment of the present invention displays various kinds of dot patterns on a screen of a CRT display device 11*a* or a liquid crystal display device 11*b* shown in FIG. 2, by effecting a data exchange with a CPU 12 (FIG. 1) which is a device that is external to the controller 10. The screen of the liquid crystal display device 11*b* is constituted by an upper display block A and a lower display block B. A memory 13 (FIG. 1) stores data and various programs to be executed by the CPU 12.

Each of the constituent elements of the display controller 10 will be explained below in detail.

A pulse generator 14 generates a train of dot clock pulses $\phi$, the period of which corresponds to the time required to display each dot on the display screen. The dot clock pulses $\phi$ are supplied to a horizontal counter 15 (FIG. 1), parallel-to-serial converters 16 and 17 (FIG. 1) and a display control circuit 18 (FIG. 2). The horizontal counter 15 counts the dot clock pulses $\phi$ to provide a count output H which indicates a current horizontal scanning position on the display screen. The count output H of the counter 15 is supplied to both of the display control circuit 18 (FIG. 2) and a comparator 19 (FIG. 1). The maximum count of the horizontal counter 15 is set to a value equal to the total number of dots displayed in one horizontal line, or one row of dots on the display screen. The counter 15 repeatedly effects the count operation within a count range between the initial value and the maximum value. When the count output H of the counter 15 returns from the maximum value to the initial value, it supplies a pulse signal $P_1$ to a vertical counter 20. As a consequence, the count valve V of this vertical counter 20 represents a vertical scanning position on the display screen. A count range of this vertical counter 20 is changed in accordance with a display device selection signal L/C supplied to a terminal $T_1$. The count output V of the vertical counter 20 is delivered both to one of input terminals of an adder 21 and the display control circuit 18. The other input terminal of the adder 21 is supplied with a fixed data of either "100" (decimal) or "0" through a gate 22 which is controlled by a signal UD. This signal UD is a pulse signal produced by the display control circuit 18 when the L/C signal indicates that the liquid crystal display device 11*b* is to be used, and becomes "0" level and "1" level, respectively, when the scanning location is on the upper half A and lower half B of the liquid crystal display screen. When the CRT display 11*a* is used, the signal UD is not generated, i. e., the level of this signal UD is always "0".

Figure 3:
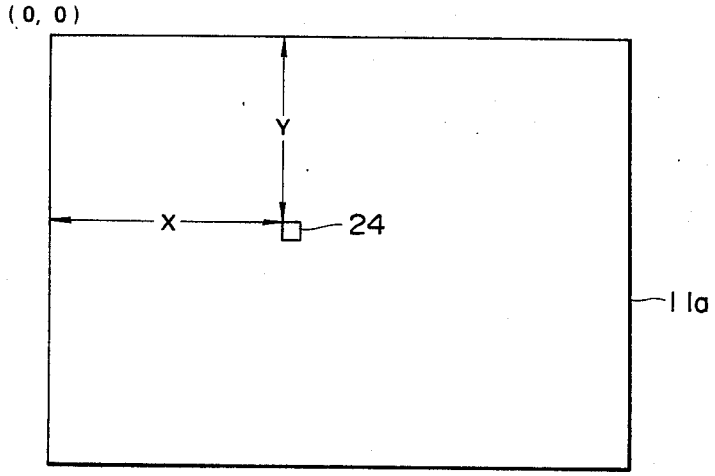
FIG. 3 is a front elevational view of a display screen of a CRT display device 11*a* in the embodiment shown in FIGS. 1 and 2.
Figure 4:
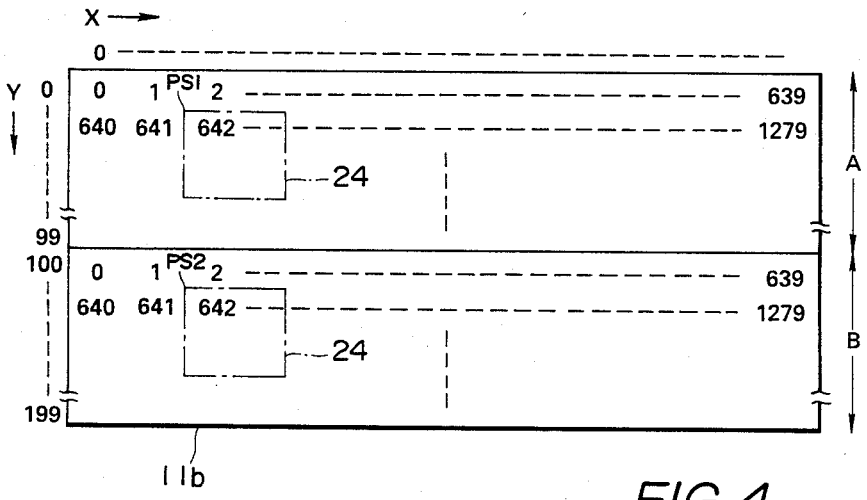
FIG. 4 is a front elevational view of a display screen of the liquid crystal display device 11*b* in the embodiment shown in FIGS. 1 and 2.

The comparator 19 compares the count output H with data held in a register 23. If these values coincide with each other, the comparator 19 supplies a coincidence-detection pulse $P_2$ to one input terminal of an AND gate $AN_1$. In this case, the data held in the register 23 represents X-coordinate of a cursor 24, as shown in FIGS. 3 and 4, the data being written into the register 23 by the CPU 12. Similarly, data representing a Y-coordinate of the cursor 24 is written into a register 25 by the CPU 12. The data in the register 25 is delivered to an adder 26 through inverters INV.

The X- and Y-coordinates of the cursor 24 can be set in the same way for both the liquid crystal display device 11*b* and the CRT display device 11*a*. The manner of setting X- and Y-coordinates of the cursor 24 for each of the CRT display device 11*a* and the liquid crystal display device 11*b* will now be described.

Referring first to FIG. 3 showing the screen of the CRT display device 11*a*, the origin (0, 0) of the coordinates is set at the left upper corner of the display screen. The X-coordinate is represented by an offset in the right hand direction from the origin (0, 0), while the Y-coordinate is represented by the downward offset from the origin. Referring now to FIG. 4 illustrating the screen of the liquid crystal display device 11*b*, the display screen is divided into two blocks, namely, the upper display block A and the lower display block B. Each of the blocks A and B is constituted by a 640×100 dot-matrix as illustrated. When the cursor 24 is located at a position PS1, the X- and Y-coordinates are given as (2, 1), whereas, when the cursor 24 is located at a position PS2, the X- and Y-coordinates thereof are given as (2, 101). Thus, when the liquid crystal display 11*b* is used, the X- and Y-coordinates of the cursor 24 are designated such that the two display blocks A and B constitute, in combination, a single screen. Thus, the designation of the coordinate positions of the cursor 24 on the screen of the liquid crystal display device 11*b* can be made in the same way as that used for the CRT display device 11*a*. It will be seen that the position of the cursor 24 is represented by the position of the upper-left corner dot thereof.

In FIG. 1, a carry input terminal Ci of the adder 26 is always being supplied with a "1" signal. Thus, the adder 26 carries out an addition of the two's complement of the data held in the register 25 to an output data AV of the adder 21. In other words, the adder 26 acts to subtract the data in the register 25 from the data AV. Higher-order output terminals of the adder 26 are respectively connected to input terminals of a NOR gate $NOR_1$, and a carry output terminal Co of the adder 26 is connected to a remaining input terminal of the NOR gate $NOR_1$ through an inverter $INV_1$. An output terminal of the NOR gate $NOR_1$ is connected to the other input terminal of the AND gate $AN_1$, and an output terminal of this AND gate $AN_1$ is connected to one input terminals of OR gates $OR_5$ and $OR_6$ and to a reset terminal R of an RS flip-flop 27. An output signal of the NOR gate NOR1 is supplied as a cursor display enable signal EN to various gates which will be mentioned later.

Figure 5:
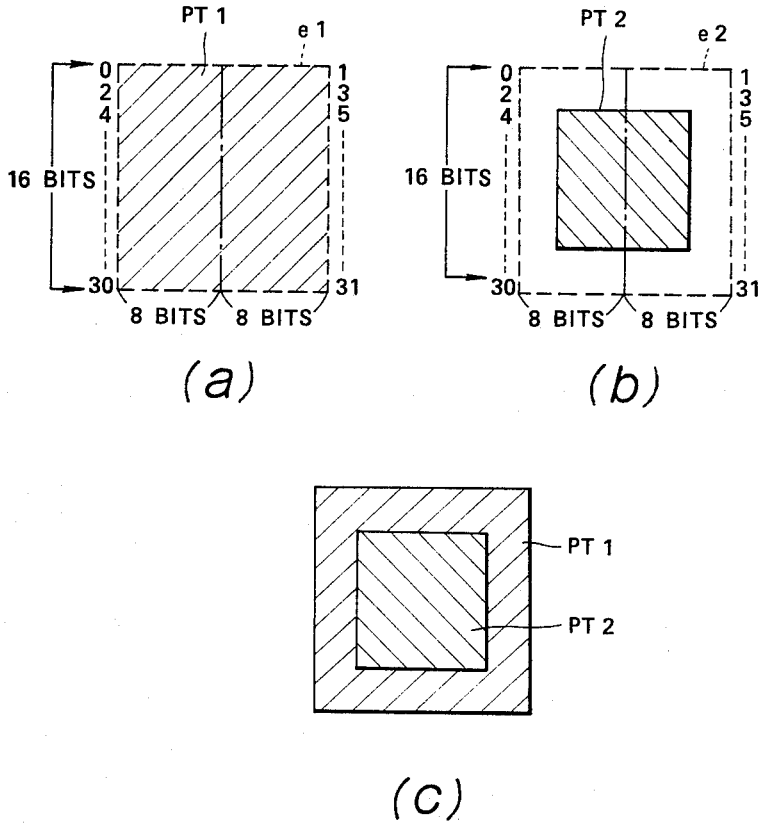
FIGS. 5-(*a*) and 5-(*b*) are illustrations showing data representative of cursor patterns PT1 and PT2 stored in the respective cursor pattern memories 28 and 29.

Cursor pattern memories 28 and 29 are 8×32-bit memories for respectively storing cursor patterns PT1 and PT2 having configurations different from each other, the patterns PT1 and PT2 being written into the memories 28 and 29 by the CPU 12. The pattern PT2 is smaller than the pattern PT1, so that the pattern PT2 is superimposed on the pattern PT1 when displayed on the screen. FIGS. 5-(*a*) and 5-(*b*) respectively show examples of the patterns PT1 and PT2. Areas $e_1$ and $e_2$ surrounded by broken lines in FIGS. 5-(*a*) and 5-(*b*) represent memory areas of the cursor pattern memories 28 and 29, respectively. The numerals on the both sides of each of the memory areas $e_1$ and $e_2$ represent memory addresses thereof in decimal. In this case, the pattern PT1 is a square pattern composed of 16×16 dots, while the pattern PT2 is displayed on the screen as a square pattern composed of 10×10 dots. Hatched portions of the areas $e_1$ and $e_2$ represent the respective cursor patterns and are stored with "1" bits. In actual display, these patterns PT1 and PT2 are superimposed one upon the other, as shown in FIG. 5-(*c*). Address input terminals $AD_4$ to $AD_1$ of each of the cursor pattern memories 28 and 29 are connected respectively to the lower-bit (four bits) output terminals of the adder 26, and address input terminals $AD_0$ thereof are connected to an output terminal Q of the flip-flop 27. And therefore, the memories 28 and 29 are accessed by the four lower-order output bits of the adder 26 and the signal outputted from the Q terminal of the flip-flop 27 simultaneously. However, when the patterns PT2 and PT1 are written by the CPU 12, the addressing of the cursor pattern memories 28 and 29 is controlled by the CPU 12.

The parallel-to-serial converters 16 and 17 store 8-bit parallel data read respectively from cursor pattern memories 28 and 29 thereinto when a signal outputted from the OR gate $OR_5$ rises, while when the signal falls or decays, the parallel-to-serial converters 16 and 17 begin to shift out the stored data from respective output terminals So thereof in accordance with the dot clock pulses $\phi$. The output terminals So of the parallel-to-serial converters 16 and 17 are directly connected respectively to the highest-bit stages thereof. Therefore, when the parallel data is loaded onto each of the parallel-to-serial converters 16 and 17, the highest-order bit of each of the parallel data is outputted at the time of the loading thereof. A serial output of the parallel-to-serial converter 16 is fed through an AND gate $AN_3$, back to an input terminal Si thereof when the signal EN is in the "0" state. When the signal EN is the 1 state, the serial output is fed through an AND gate $AN_4$ to one input terminal of a NAND gate $NAN_1$ as a cursor pattern signal $CPS_1$. Similarly, a serial output of the parallel-to-serial converter 17 is fed through an AND gate $AN_5$ to an input terminal Si thereof when the signal EN is in the "0" state, while when the signal EN is in the 1 state, the serial output is fed through an AND gate $AN_6$ to one input terminal of an AND gate $AN_2$ as a cursor pattern signal $CPS_2$.

In FIG. 1, an eight-bit shift register 30 is adapted to shift, in accordance with the clock signal $\phi$, data supplied to an input terminal Si thereof. An output signal from the shift register 30 is fed back to the input terminal Si through an AND gate $AN_8$ and an OR gate $OR_6$ when the signal EN is in the "0" state. On the other hand, when the signal EN is in the "1" state, the output signal of the shift register 30 is fed through an AND gate $AN_7$ to a set terminal S of the flip-flop 27 and to the other input terminal of the OR gate $OR_5$.

A video memory 40 stores four-bit color codes, each representative of a color of a respective one of the display dots provided on the entire screen. In the case of the liquid crystal display device 11*b* being used, the video memory 40 stores data each representing gray scale of a respective one of the display dots in place of the color codes. In the illustrated embodiment, color codes corresponding to eight display dots are read from the video memory 40 by each reading operation. For example, the video memory 40 comprises four memory devices connected to one another in parallel, each of which stores 8-bit data in each address, so that 32-bit data is read out at once from the same addresses of the four memory devices. The color codes are read from and written into the video memory 40 by the display control circuit 18. The relationship between the color codes and the colors of the displayed dots is shown in FIG. 6. In FIG. 6, symbols RD, GD and BD respectively represent color data obtained by decoding the color codes and constitute luminance information of red, green and blue colors. The decoding is conducted by a color palette 41 shown in FIG. 2.

The display control circuit 18 is arranged so as to recognize the current scanning position on the display screen, in accordance with the dot clock pulses $\phi$, count output H, count output V and the adder output data AV. The display control circuit 18 is also arranged so as to read the color codes corresponding to the current scanning position from the video memory 40. The reading processing effected by the circuit 18 when the CRT display device 11*a* is used is different from that effected when the liquid crystal display device 11*b* is used, as will be understood from the following description.

When the CRT display device 11*a* is used, the scanning is performed from the upper end towards the lower end of the display screen. Therefore, color codes for eight dots are successively read as the scanning proceeds, and each of the thus read color codes are outputted on a one-dot (or four-bit) unit basis at a speed determined by the dot clock $\phi$. This processing is repeatedly carried out as the scanning proceeds.

A processing different from that explained above is effected when the liquid crystal display device 11*b* is used, because in such a case both of the display blocks A and B (see FIG. 4) are scanned simultaneously or in parallel. In this case, the color codes corresponding to the 0th to 7th dots on the first horizontal scanning line in the display block A are read first, and then the color codes corresponding to 0th to 7th dots on the first horizontal scanning line in the display block B are read. Subsequently, the color codes corresponding to the 8th to 15th dots on the first scanning line of the display block A are read. In this manner, the color codes for the display blocks A and B are alternately read on an eight-dot unit basis. The color codes thus read out are outputted from the display control circuit 18, dot by dot, at a speed which is twice as high as that of the dot clock pulse $\phi$. Thus, color codes for eight consecutive dots in the display block A and color codes for eight consecutive dots in the display block B are outputted alternately. This reading operation will be more fully described later.

When the CRT display device 11*a* is used, the display control circuit 18 outputs a horizontal synchronization signal HSYNC and a vertical synchronization signal VSYNC to the CRT display device 11*a* in accordance with the count outputs H and V. When the liquid crystal display device 11*b* is used, the display control circuit 18 outputs various timing signals to the liquid crystal display device 11*b* in accordance with the count outputs H and V. The display control circuit 18 is also arranged so as to rewrite the color codes in the video memory 40 in accordance with various commands delivered from the CPU 12. Respective bits of each of the four-bit color codes outputted from the display control circuit 18 are supplied to one input terminal of four AND gates $AN_{10}$ to $AN_{13}$.

This display controller 10 further comprises a 2-bit register 46, a 4-bit register 47 and a 4-bit register 48 whose contents are changed by the CPU 12. Bit data $D_0$ and $D_1$ outputted from the register 46 are supplied to the other or second input terminals of the NAND gate $NAN_1$ and the AND gate $AN_2$, respectively. Four bit data $D_0$ to $D_3$ outputted from the register 47 are supplied to one input terminals of four OR gates $OR_0$ to $OR_3$, respectively, and similarly, four bit data $D_0$ to $D_3$ outputted from the register 48 are supplied to one input terminal of four AND gates $AN_{20}$ to $AN_{23}$, respectively. An output terminal of the NAND gate $NAN_1$ is connected to all of the other input terminals of the OR gates $OR_0$ to $OR_3$, and an output terminal of the AND gate $AN_2$ is connected to all of the other input terminals of the AND gates $AN_{20}$ to $AN_{23}$. Each of the registers 47 and 48 are written with a color code by the CPU 12, and this color code is used in a logical operation as later described.

Output terminals of the OR gates $OR_0$ to $OR_3$ are connected respectively to the other input terminals of the AND gates $AN_{10}$ to $AN_{13}$, and output terminals of the AND gates $AN_{10}$ to $AN_{13}$ are connected respectively to of the one input terminals of four exclusive-OR gates $EXOR_{10}$ to $EXOR_{13}$. Further, output terminals of the AND gates $AN_{20}$ to $AN_{23}$ are connected respectively to the other input terminals of the exclusive-OR gates $EXOR_{10}$ to $EXOR_{13}$, and output signals from the exclusive-OR gates $EXOR_{10}$ to $EXOR_{13}$ are supplied as a color code to input terminals of the color palette 41, wherein the supplied color code is converted into the color data RD, GD and BD. The color data RD, GD and BD outputted from the color palette 41 are passed through digital-to-analog converters $DAC_{50}$ to $DAC_{52}$ so as to be outputted as analog color signals R, G and B, respectively. These digital-to-analog converters $DAC_{50}$ to $DAC_{52}$ are used only when the CRT display device 11*a* is used.

The color data RD, GD and BD are also supplied to a luminance computing circuit 53.

The luminance computing circuit 53 produces a luminance or an intensity data YD by effecting the following arithmetic operation on the color data RD, GD and BD:

$$
\begin{array}{rrrrr}
 & & R_2 & R_1 & R_0 \\
 & & & & R_2 \\
 & & & B_2 & B_1 \\
(+) & G_2 & G_1 & G_0 & G_2 \\
\hline
\end{array}
$$

-continued

| $Y_4$ | $Y_3$ | $Y_2$ | $Y_1$ | $Y_0$ |
|---|---|---|---|---|

Wherein $R_0$, $R_1$ and $R_2$ are the first, second and third bits of the color data RD, respectively, and this is true with $G_0$ to $G_2$ and $B_0$ to $B_2$. Only the second to fourth bits $Y_1$ to $Y_3$ of the computation result are outputted as the luminance data YD. The aforesaid arithmetic operation bases on the following well-known equation for converting analog RGB signals into a luminance signal:

$$Y=0.3R+0.59G+0.11B$$

The luminance data YD outputted from the luminance computation circuit 53 is supplied to a gray-scale display circuit 54.

The gray-scale display circuit 54 is provided for implementing a gray-scale display on the screen of the liquid crystal display device 11*b* in accordance with the luminance data YD. In contrast to the case of a CRT display screen being used, a gray-scale display of a dot on the liquid crystal display screen must be performed such that the greater the luminance data is, the darker the display dot becomes, and that the smaller the luminance data, the brighter the display dot. Consequently, the luminance data YD of "0" represents black, and the luminance data YD of "7" represents white.

The gray-scale display effected in this embodiment will now be described.

In this embodiment, display of dots on the liquid crystal display screen is effected at a speed of 70 frames per second, wherein eight frames constitutes one display period. And within each display period, each display dot on the liquid crystal display screen is activated in the frames determined in accordance with the luminance data YD, the number of frames corresponding to the luminance data YD. When the luminance data YD for a given dot is "7", the dot is activated in each of eight frames within each display period, that is to say, eight times per display period. When the luminance data YD is "6", the dot is activated in six frames within each display period. When the luminance data YD is "0" (white), the dot is not activated in any one of the eight frames within each display period. The gray-scale display circuit 54 generates serial display data LD which is rendered "1" when the corresponding dot is to be activated in the frame and is rendered "0" when the dot should not be activated in the frame. The serial display data LD is supplied to a distribution circuit 55. In this case, the display data LD is supplied on a sixteen-bit unit basis, wherein each unit is composed of eight-bit serial data LD*a* for eight display dots in the display block A followed by eight-bit serial data LD*b* for eight display dots in the display block B, as will be seen from FIG. 8-(*b*). Thus, during each frame, each unit of the display data LD causes eight dots in each of the display blocks A and B to be displayed.

The distribution circuit 55 is adapted to separate the eight-bit data LD*a* for the display block A and the eight-bit data LD*b* for the display block B from the display data LD and supplies the data LD*a* and LD*b* in parallel to the liquid crystal display device 11*b*. As stated before, the data LD from the gray-scale display circuit 54 contains the eight-bit data LD*a* and eight-bit data LD*b*, and the data LD*a* and LD*b* are outputted alternately. The distribution circuit 55 latches the data LD on a sixteen-bit unit basis and divides the latched data into the data LD*a* and LD*b*. The distribution circuit 55 then delivers both the data LD*a* and LD*b* bit-by-bit but in parallel to the liquid crystal display device 11*b* at a speed corresponding to the dot clock $\phi$. As described above, the display control circuit 18 outputs the color codes at a speed which is twice as high as that of the clock pulse $\phi$, so that the speed of transfer of the data LD from the gray-scale display circuit 54 is also twice as high as that of the dot clock pulse $\phi$. The distribution circuit 55 latches the data LD on a sixteen-bit unit basis, divides the same into the two data LD*a* and LD*b* each composed of eight bits, and outputs the data LD*a* and LD*b* in parallel at a speed which is half of that of the input data LD, that is, at the speed corresponding to the dot clock pulse $\phi$. Thus, the input and output data of the distribution circuit 55 are synchronized with each other, so that the amount of data inputted to the distribution circuit 55 and the amount of data outputted therefrom coincide to each other (see FIGS. 8-(*b*) and 8-(*c*)).

The operation of this embodiment will now be described.

There are two kinds of operation, namely, the operation for the CRT display device 11*a* and that for the liquid crystal display device 11*b*. A description is first given as to the operation for the CRT display device 11*a*.

When the CRT display device 11*a* is used, the signal UD is not generated, so that the gate 22 in FIG. 1 is kept closed. Therefore, the output AV of the adder 26 always coincides with the count output V.

Figure 7:
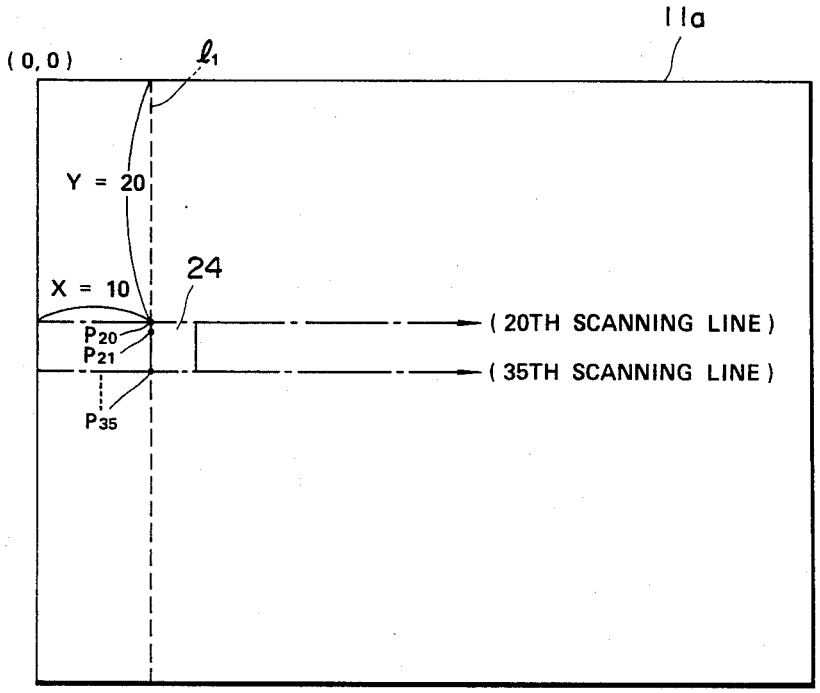
FIG. 7 is an illustration showing the timing of display of the cursor 24 in the case of the CRT display device 11*a* being used.

The operation of the adder 26 in this case is as follows:

Assuming now that the X- and Y-coordinate data of the cursor 24 stored in the registers 23 and 25 are "10" and "20" in decimal, respectively, the comparator 19 outputs the pulse $P_2$ each time the count output H of the horizontal counter 15 reaches "10" in decimal, that is, each time the horizontal scanning line intersects the imaginary vertical straight line $l_1$ shown in FIG. 7. As the horizontal scanning line successively shifts downward from the top of the screen, the count output V of the vertical counter 20 increases, so that the data outputted from the adder 26 is sequentially incremented by one. In this case, the adder 26 carries out a subtraction of the data held in the register 25 from the count output V of the vertical counter 20. Accordingly, until the count output V reaches "20" in decimal, the result of the subtraction effected by the adder 26 is negative, and no carry signal is outputted from the terminal Co of the adder 26. When the count output V reaches "20", the data outputted from the adder 26 is rendered "0", and a "1" signal is outputted from the carry output terminal Co. As a result, "0" signals are supplied to all the input terminals of the NOR gate $NOR_1$, and a "1" signal is consequently outputted from the output terminal of the NOR gate $NOR_1$. In other words, assuming that the uppermost horizontal scanning line is the 0th horizontal scanning line, a "1" signal is outputted from the output terminal of the NOR gate $NOR_1$ when the 20th horizontal scanning line appears on the screen. The result of the calculation carried out by the adder 26 is "0" when the 20th horizontal line is scanned, and thereafter, each time the horizontal scanning line is shifted downward by one line, for example, from the 20th scanning line to the 21st, or from the 21st to the 22nd, the calculation result of the adder 26 is incremented by one. Therefore, the calculation result is "15" in decimal when the 35th horizontal line is scanned. While the calculation result of the adder 26 is between "0" and "15", the higher-order bits of the output of the adder 26 are all "0", and a "1" signal is outputted from the carry output terminal Co. Consequently, all the input signals to the NOR gate $NOR_1$ are rendered "0", and therefore, the signal EN in the state of "1" is outputted from the NOR gate $NOR_1$. Since the pulse signal $P_2$ is outputted each time a horizontal scanning line intersects the imaginary vertical straight line $l_1$ shown in FIG. 7, the output signal of the AND gate $AN_1$ is rendered "1" when the 20th to 35th horizontal scanning lines intersect the line $l_1$ at display points $P_{20}$ to $P_{35}$ shown in FIG. 7. When a horizontal line disposed downwardly of the 35th horizontal scanning line is scanned, the higher-order bits of the output of the adder 21 includes at least one signal in the state of "1", and therefore from the 36th horizontal scanning line, NOR gate $NOR_1$ never outputs the signal EN in the state of "1".

The operation of the parallel-to-serial converters 16 and 17 and the shift register 30 will now be described.

When the scanning of the screen reaches the point $P_{20}$ in FIG. 7, the output of the AND gate $AN_1$ outputs a "1" signal. This "1" signal is fed to the load terminals L of the parallel-to-serial converters 16 and 17 through the OR gate $OR_5$. In consequence, the parallel-to-serial converter 16 and 17 load eight-bit data outputted from the cursor pattern memories 28 and 29 thereon, respectively. The data loaded onto the parallel-to-serial converters 16 and 17 will now be described.

When the 20th scanning line reaches the point $P_{20}$ in FIG. 7, the output signal of the AND gate $AN_1$ is rendered "1", so that the flip-flop 27 is reset and the lower-order four bits of the output of the adder 26 become "0000". Therefore, the address input terminals $AD_4$ to $AD_0$ are supplied with data of "00000" at this time, so that the addresses "0" of the cursor pattern memories 28 and 29 are accessed. More specifically, when the scanning of the screen has reached the point $P_{20}$, eight-bit data in the addresses "0" of the cursor pattern memories 28 and 29 (see FIG. 5) are read and supplied to the parallel-to-serial converters 16 and 17, respectively. When the scanning goes beyond the point $P_{20}$, the output signal of the AND gate $AN_1$ is rendered "0", so that the signal applied to the load terminals L of the parallel-to-serial converters 16 and 17 are also rendered "0". As a result, the data loaded on the parallel-to-serial converters 16 and 17 begin to be shifted out. Since the signal EN is maintained in the "1" state during the time when the scanning proceeds from the 20th scanning line to the 35th scanning line, the data shifted out of the parallel-to-serial converters 16 and 17 are supplied through the AND gates $AN_4$ and $AN_6$ to the NAND gate $NAN_1$ and the AND gate $AN_2$, respectively.

On the other hand, when the scanning has reached the point $P_{20}$, the "1" signal outputted from the AND gate $AN_1$ is loaded on the shift register 30 through the OR gate $OR_6$. This "1" signal is outputted from the shift register 30 when each of the parallel-to-serial converters 16 and 17 has shifted the loaded data by eight bits. The "1" signal outputted from the shift register 30 is supplied through the AND gate $AN_7$ to the set terminal S of the flip-flop 27 and to the load terminals L of the parallel-to-serial converters 16 and 17. Consequently, the parallel-to-serial converters 16 and 17 are again loaded with the eight-bit data read from the cursor pattern memories 28 and 29, respectively. In this case, the flip-flop 27 has been set, while the output of the adder 26 has been kept unchanged, so that the address terminals $AD_4$ to $AD_0$ are supplied with binary data "00001". As a result, the addresses "1" of the both cursor pattern memories 28 and 29 are accessed. When the data from the addresses "1" are loaded onto the parallel-to-serial converters 16 and 17, the signal applied to the load terminals L thereof falls to "0", so that the parallel-to-serial converters 16 and 17 again begin to shift out the loaded data. Thus, the data representative of the left-hand eight dots of the uppermost rows of dots of the cursor patterns PT1 and PT2 (FIG. 5) are first read from the cursor pattern memories 28 and 29 and are converted into serial data. And immediately after the parallel-to-serial conversions are completed, the data representative of the right-hand eight dots of the uppermost rows of dots of the cursor patterns PT1 and PT2 are read and begin to be converted into serial data. When the shifts out of the data representative of the right-hand eight dots are completed, the parallel-to-serial converters 16 and 17 output "0" signals and continue to output the "0" signals thereafter until the loadings of data are effected again.

When the scanning of the 20th horizontal line is completed, scanning of 21st horizontal line is commenced. When the scanning of the 21st horizontal line reaches the point $P_{21}$ shown in FIG. 7, the output signal of the AND gate $AN_1$ is again rendered "1", so that the loading of data onto the parallel-to-serial converters 16 and 17 is effected. At this time, the flip-flop 27 is reset, and the lower-order four bits of the output of the adder 26 are "0001", and therefore, the address input terminals $AD_4$ to $AD_0$ are supplied with binary data of "00010". Consequently, the data in the addresses "2" are read out. Upon completion of the parallel-to-serial conversion of these data by the parallel-to-serial converters 16 and 17, the "1" signal stored into the shift register 30 at the time of display of the dot $P_{21}$ is delayed by eight bit-times and outputted therefrom, so that the flip-flop 27 is brought into a set state. As a result, address data of "00011" is fed to the address input terminals $AD_4$ to $AD_0$, whereupon the data in the addresses "3" are read out. At this time, the parallel-to-serial converters 16 and 17 effect loading operations, so that the data read from the addresses "3" are loaded onto the parallel-to-serial converters 16 and 17. Thus, the data read from the addresses "3" begin to be converted into serial forms immediately after the conversions of the data read from the addresses "2" are completed.

From the foregoing, it will be appreciated that the parallel-to-serial converters 16 and 17 successively output the serial pattern data (cursor pattern signals $CPS_1$ and $CPS_2$) of the cursor patterns PT1 and PT2 shown in FIGS. 5-(*a*) and 5-(*b*) in synchronization with the display timing of the cursor 24.

The operations of the registers 46, 47 and 48 will now be described.

The serial pattern data thus outputted from the parallel-to-serial converter 16 is supplied to the one input terminal of the NAND gate $NAN_1$. When the bit $D_0$ in the register 46 is "0", the signal outputted from the NAND gate $NAN_1$ is "1" regardless of the state of the signal outputted from the parallel-to-serial converter 16. In consequence, the output signals from the OR gates $OR_0$ to $OR_3$ are all "1", and all the AND gates $AN_{10}$ to $AN_{13}$ are enabled to open, so that a four-bit color code outputted from the display control circuit 18 is allowed to pass through the AND gates $AN_{10}$ to $AN_{13}$. Thus, the cursor pattern PT1 is neglected.

On the other hand, when the bit $D_0$ in the register 46 is "1", the NAND gate $NAN_1$ functions as an inverter with respect to the output signal from the parallel-to-serial converter 16. Therefore, when the output signal $CPS_1$ from the parallel-to-serial converter 16 is "0", the output signal from the NAND gate $NAN_1$ is "1", and the AND gates $AN_{10}$ to $AN_{13}$ are consequently enabled to open. When the output signal $CPS_1$ from the parallel-to-serial converter 16 is "1", the output signal from the NAND gate $NAN_1$ is "0". In this case, the respective output signals from the OR gates $OR_0$ to $OR_3$ coincide with the color code held in the register 47. In other words, the color code held in register 47 is outputted from the OR gates $OR_0$ to $OR_3$. In consequence, the data outputted from the AND gates $AN_{10}$ to $AN_{13}$ is a logical product of the color code outputted from the display control circuit 18 and the color code which has been written into the register 47. Since the color code outputted from the display control circuit 18 at this time designates the color of the background of the cursor 24, the color code outputted from the AND gates $AN_{10}$ to $AN_{13}$ is a logical product of the color code in the register 47 and the color code of the background color.

As will be clearly understood from the above description, when the bit $D_0$ in the register 46 is "0", the cursor pattern PT1 stored in the cursor pattern memory 28 is not displayed, while when the bit $D_0$ in the register 46 is "1", the cursor pattern PT1 is displayed in a color determined by a logical product of the color code in the register 47 and the color code of the background color.

The signal $CPS_2$ outputted from the parallel-to-serial converter 17 is supplied to the one input terminal of the AND gate $AN_2$. When the bit $D_1$ in the register 46 is "0", the signal outputted from the AND gate $AN_2$ is "0" regardless of the state of the signal $CPS_2$ outputted from the parallel-to-serial converter 17, and consequently, all the signals outputted from the AND gates $AN_{20}$ to $AN_{23}$ are rendered "0". Thus, the exclusive-OR gates $EXOR_{10}$ to $EXOR_{13}$ function simply as buffers for the output signals from the AND gates $AN_{10}$ to $AN_{13}$. As a result, the color code outputted from the AND gates $AN_{10}$ to $AN_{13}$ is allowed to pass through the exclusive-OR gates $EXOR_{10}$ to $EXOR_{13}$ and is supplied to the input terminals of the color palette 41. Thus, the cursor pattern PT2 is neglected.

On the other hand, when the bit $D_1$ in the register 46 is "1", the AND gate $AN_2$ is enabled to open, so that the output signal $CPS_2$ from the parallel-to-serial converter 17 is allowed to pass through the AND gate $AN_2$ and is supplied to the one input terminals of the AND gates $AN_{20}$ to $AN_{23}$. In consequence, when the output signal $CPS_2$ from the parallel-to-serial converter 17 is "1", the color code held in the register 48 is supplied to the exclusive-OR gates $EXOR_{10}$ to $EXOR_{13}$. Thus, the color code supplied to the color palette 41 is an exclusive-OR sum of the color code outputted from the AND gates $AN_{10}$ to $AN_{13}$ and the color code in the register 48. When the output signal $CPS_2$ from the parallel-to-serial converter 17 is "0", all the signals outputted from the AND gates $AN_{20}$ to $AN_{23}$ are "0". Therefore, the color code outputted from the AND gates $AN_{10}$ to $AN_{13}$ is supplied through the exclusive-OR gates $EXOR_{10}$ to $EXOR_{13}$ to the color palette 41.

As will be understood from the above description, when the bit $D_1$ in the register 46 is "0", the cursor pattern PT2 stored in the cursor pattern memory 29 is not displayed, while when the bit $D_1$ of the register 46 is "1", the cursor pattern PT2 is displayed in a color determined by the exclusive-OR sum of the color code outputted from the AND gates $AN_{10}$ to $AN_{13}$ and the color code held in the register 48.

The foregoing is the operation of the display controller 10 carried out when the CRT display device 11*a* is used.

The operation of the display controller 10 effected when the liquid crystal display device 11*b* is used will now be described.

As mentioned before, in the case where the liquid crystal display device 11*b* is used, the display is performed in the form of gray-scale display instead of the color display. To this end, the luminance computing circuit 53, gray-scale display circuit 54 and distribution circuit 55 are used in place of the digital-to-analog converters $DAC_{50}$ to $DAC_{52}$. On the other hand, when the liquid crystal display device 11*b* is used, the vertical counter 20 repeats the counting operation within the range of between "0" and "99" in decimal, because each of the display blocks A and B comprises a hundred horizontal lines.

Description will be first given as to the display operation of the background of the image on the screen.

When the liquid crystal display device 11*b* is used, the display control circuit 18 produces the signal UD. As mentioned before, the signal UD is in a "0" state when the display control circuit 18 reads data concerning the display block A, and is in a "1" state when it reads data concerning the display block B. Therefore, the gate 22 outputs the data of "0" when the data concerning the display block A are read from the video memory 40 and outputs the data of "100" in decimal when the data concerning the display block B are read from the video memory 40. Consequently, when the data concerning the display block A are read, the output data AV of the adder 21 coincides with the count output V of the vertical counter 20, while when the data concerning the display block B are read, the output data AV of the adder 21 becomes equal to the sum of the count output V and the data representative of "100". The signal level of the signal UD is changed each time a time period corresponding to eight display dots lapses.

The display control circuit 18 reads the color codes from the video memory 40 in accordance with the data AV in the following manner.

Figure 8:
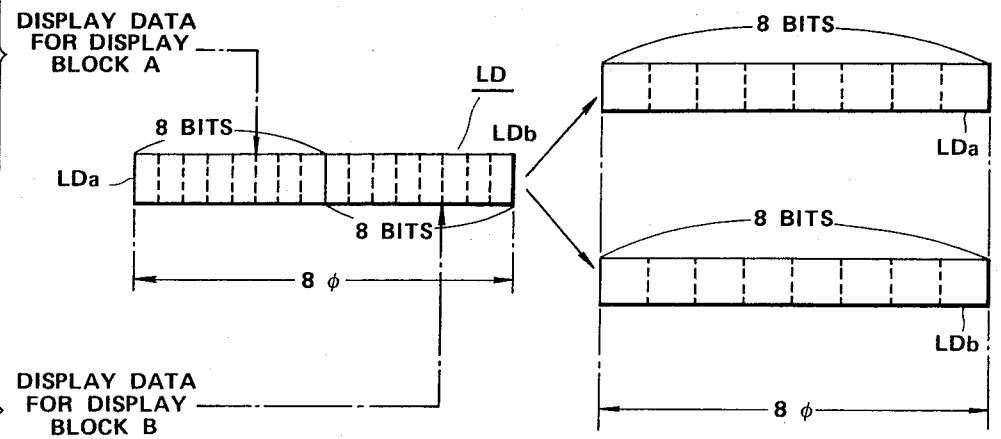
FIGS. 8-(*a*) to 8-(*c*) show, respectively, the data in the video memory 40, display data LD outputted from a gray-scale display circuit 54, and relationship between the data LD*a* and LD*b* both outputted from the distribution circuit 55.

When the scanning of the screen is commenced, the count output V of the vertical counter 20 is "0". The signal UD is also "0" because the color codes for the display block A are read first. And therefore, the data AV is also "0", so that the display control circuit 18 reads the color codes corresponding to the 0th to 7th dots of the display block A from the video memory 40. When the reading of the color codes for the display block A is completed, the state of the signal UD is changed from "0" to "1", so that the value of the data AV becomes equal to "100" in decimal. Consequently, the display control circuit 18 reads the color codes corresponding to the 0th to 7th dots of the display block B. Thereafter, the display control circuit 18 automatically increments the addresses, without references to the data AV, to thereby successively and alternately read the color codes for the display blocks A and B on an eight-bit unit basis. More specifically, as shown in FIG. 8-(*a*), the color codes corresponding to the 8th to 15th dots of the display block A are read and then the color codes corresponding to the 8th to 15th dots of the display block B are read. And thereafter, reading operation similar to the above is repeatedly carried out.

When the scanning of the first horizontal lines of the display blocks A and B is commenced in response to the increment of the vertical counter 20, the data AV alternately takes values "1" and "101". Therefore, the display controller 18 reads the color codes for the 640th to 647th dots of the display block A when the data AV first becomes "1", and reads the color codes for the 640th to 647th dots of the display block B when the data AV first becomes "101". Thereafter, the display control circuit 18 automatically increments the addresses, without references to the data AV, to thereby successively and alternately read the color codes for the display blocks A and B on an eight-bit unit basis.

The foregoing is the operation of the display control circuit 18 for reading the color codes.

The thus read color codes are converted into the aforesaid display data LD*a* and LD*b* through the color palette 41, luminance computing circuit 53, gray-scale display circuit 54 and distribution circuit 55. The display data LD*a* and LD*b* are then fed to the liquid crystal display device 11*b*, thereby the background is displayed on the display blocks A and B.

A description will now be given as to the display of the cursor 24. The function of the registers 46, 47 and 48 in this case is the same as that in the operation for the display of the cursor on the CRT display screen, and the description thereof will be omitted.

Figure 9:
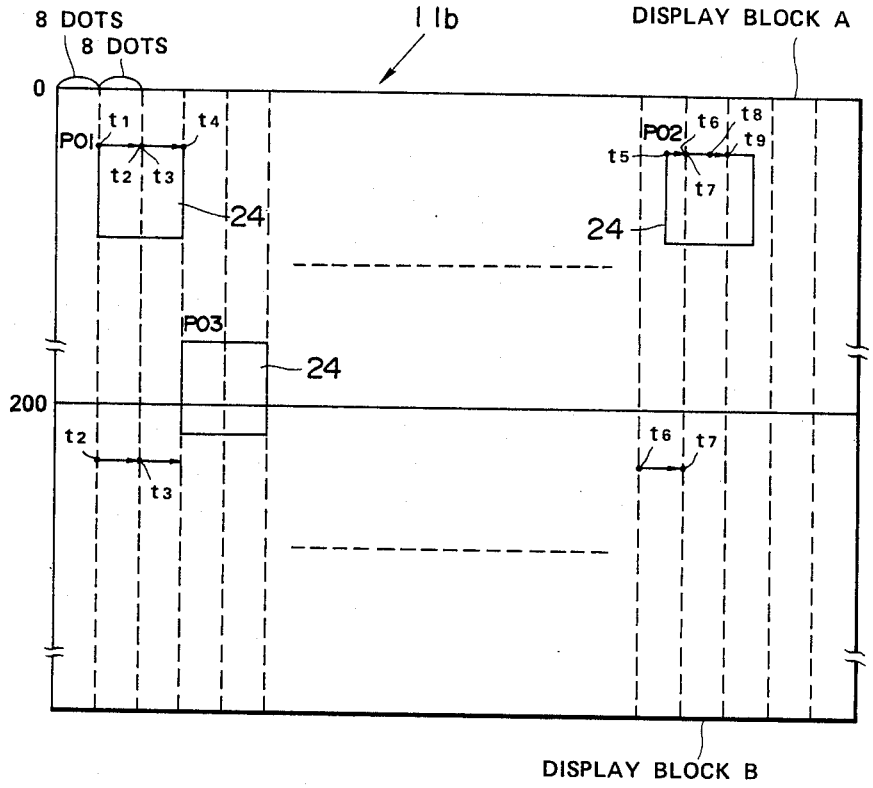
FIG. 9 is an illustration showing the timing of display of the cursor 24 in the case of the liquid crystal display device 11*b* being used.

In this embodiment, as mentioned before, the display data for eight dots of the display blocks A and B are formed alternately. Therefore, the area of the display screen of the liquid crystal display device 11*b* is divided, in accordance with the forming of the display data, into sections separated by imaginary vertical lines spaced from each other by eight dots, as shown in FIG. 9. Since the cursor 24 is composed of a 16×16 dot-matrix, the left-hand edge of the cursor 24 may or may not align with the imaginary vertical lines separating the aforesaid sections, depending upon the display position of the cursor 24. For example, the left-hand edge of the cursor 24 displayed at a position $P_{01}$ in FIG. 9 aligns with one of the imaginary vertical lines, while that of the cursor 24 displayed at the position $P_{02}$ does not align with any one of the imaginary vertical lines. The processing for reading the cursor pattern whose left-hand edge coincides with one of the imaginary vertical lines differs from that for reading the cursor pattern whose left-hand edge does not coincide with any one of the imaginary vertical lines.

The processing for reading the cursor pattern whose left-hand edge coincides with one of the imaginary vertical lines will first be described.

When the cursor 24 is displayed at the position $P_{01}$ shown in FIG. 9, the reading of the cursor patterns is commenced at time $t_1$ when the count outputs H and V coincide respectively to the contents of the registers 23 and 25, and data corresponding to eight dots is read from the address "0" of each of the cursor pattern memories 28 and 29. After the reading and shifting of the data corresponding to the eight dots from each of the memories 28 and 29, the signal UD is rendered "1" at time $t_2$ whereupon the data AV is increased by "100" in decimal. This causes the result of the calculation effected by the adder 26 to exceed "16", so that the signal EN outputted from the NOR gate $NOR_1$ is rendered "0". As a result, the AND gates $AN_7$ closes and the AND gate $AN_8$ opens, so that the "1" signal inputted to the shift register 30 eight bit-times before, that is, at the time $t_1$, is fed through the AND gate $AN_8$ and the OR gate $OR_6$ back to the input terminal thereof. At this time, the parallel-to-serial converters 16 and 17 are not supplied with the loading signals. On the other hand, when the signal UD is rendered "1", the display control circuit 18 reads eight color codes for the display block B. More specifically, the display control circuit 18 reads the color codes for the portion of the background to be displayed on the display block B, which portion is 100 horizontal lines below the portion displayed on the display block A, as shown in FIG. 9. When the processing of the data corresponding to the eight dots on the display block B is completed at time $t_3$, the signal UD is again rendered "0", so that the result of the calculation effected by the adder 26 again becomes equal to "0". In consequence, the signal EN is rendered "1", so that the AND gate $AN_7$ opens while the AND gate $AN_8$ closes. The "1" signal inputted to the shift register 30 at the time $t_1$ is outputted therefrom through the AND gate $AN_7$ after a lapse of a period corresponding to eight cycles of the dot clock pulses $\phi$, that is, at the time $t_3$. Consequently, the loading signal is supplied to the parallel-to-serial converters 16 and 17 and the flip-flop 27 is brought into a set state, so that the eight-bit data in the addresses "1" of the cursor pattern memories 28 and 29 are read and loaded onto the parallel-to-serial converters 16 and 17. As will be readily understood from the foregoing, the reading of the eight-bit data from the cursor pattern memories 28 and 29 and the reading of the color codes for the dots on the display block B are effected alternately in this case. And the parallel-to-serial converters 16 and 17 serially output the loaded cursor pattern data on an eight-bit unit basis.

In the above-described operation, the data loaded on the parallel-to-serial converters 16 and 17 are outputted at a speed which is twice as high as that of the dot clock pulse $\phi$. The reason for this is that when the liquid crystal display device 11*b* is used, the display control circuit 18 delivers the color codes at a speed which is twice as high as that of the dot clock pulse $\phi$.

When the Y-coordinate written in the register 25 exceeds "100" in decimal, the result of the calculation effected by the adder 26 is within the range of between "0" and "15" only when the data AV exceeds "100" and when the signal UD is in the state "1" state, so that the cursor 24 is displayed in the designated position on the display block B. Thus, the designation of the Y-coordinate of the cursor 24 can be made in the same manner as that for the CRT display device 11*a*, wherein the display screen is constituted by the upper display block A and the lower display block B, and the uppermost and lowermost horizontal lines of the display screen are 0th and 199th horizontal scanning lines, respectively.

The above operation can also be applied to the case where a part of the cursor 24 is disposed in the display block A and the remaining part thereof is disposed in the display block B, that is, when the cursor 24 is displayed, for example, at a position $P_{03}$ shown in FIG. 9.

The process for reading the cursor pattern 24 whose left-hand edge does not coincide with any one of the imaginary vertical lines will now be described.

Figure 10:
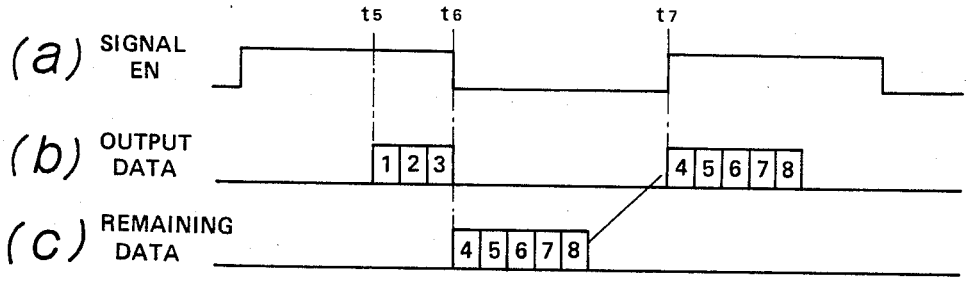
FIG. 10 is a timing chart of the signal EN and the data in the parallel-to-serial converters 16 and 17 in the case of the liquid crystal display device 11*b* is used.

It is assumed that the cursor 24 should now be displayed at the position $P_{02}$ shown in FIG. 9. In this case, when the count outputs H and V coincide with the contents of the registers 23 and 25 at time $t_5$, the eight-bit data in the addresses "0" of the cursor pattern memories 28 and 29 are read and loaded onto the parallel-to-serial converters 16 and 17 in a manner described for the above case. The data thus loaded on the parallel-to-serial converters 16 and 17 are serially outputted therefrom at a speed twice as high as the speed of the clock pulse $\phi$. At time $t_6$ when the serial output of the three higher-order bits of each of the data loaded on the parallel-to-serial converters 16 and 17 is completed, the signal UD is rendered "1", so that the data AV is increased by "100". Therefore, the result of the calculation effected by the adder 26 exceeds "16". In consequence, the signal EN is rendered "0", so that both of the AND gates $AN_{4,6}$ are closed, whereas both of the AND gate $AN_3$ and $AN_5$ are opened. As a result, the remaining five bits of the data loaded on the parallel-to-serial converter 16 and the remaining five bits of the data loaded on the parallel-to-serial converter 17 are fed back to the input terminals Si thereof through the AND gates $AN_3$ and $AN_5$, respectively. On the other hand, the display control circuit 18 starts to read the color codes for the display block B at the time $t_6$ when the signal UD rises to "1". Thus, the display control circuit 18 reads the color codes corresponding to eight dots on the display block B from the video memory 40. At time $t_7$ when the reading of the eight color codes is completed, the signal UD is again rendered "0", so that the result of the calculation effected by the adder 26 is again rendered "0", whereby the signal EN is rendered "1". Consequently, the AND gates $AN_4$ and $AN_6$ open and the AND gates $AN_3$ and $AN_5$ close. Since the contents of the parallel-to-serial converters 16 and 17 are shifted at a speed twice as high as the dot clock pulse $\phi$, the remaining five bits of each of the data loaded on the parallel-to-serial converters 16 and 17 begins to be shifted out from the output terminal So thereof at this time. As a result, from the time $t_7$, the remaining five bits of the data loaded on the parallel-to-serial converter 16 and the remaining five bits of the data loaded on the parallel-to-serial converter 17 are serially outputted through the AND gates $AN_4$ and $AN_6$, respectively. The state of the signal EN and the data contained in the parallel-to-serial converters 16 and 17 during the period from the time $t_5$ to the time $t_7$ are shown in FIG. 10. At time $t_8$ when the serial output of the remaining five bits of each of the data loaded on the parallel-to-serial converters 16 and 17 is completed, the "1" signal, which was inputted to the shift register 30 a time interval corresponding to eight cycles of the dot clock pulse $\phi$ before, i. e., at the time $t_5$, is outputted therefrom through the AND gate $AN_7$. As a result, the loading signal is supplied to the parallel-to-serial converters 16 and 17, and the flip-flop 27 is brought into a set state. Therefore, the data in the addresses "1" of the cursor pattern memories 28 and 29 are read therefrom and loaded onto the parallel-to-serial converters 16 and 17, respectively. At time $t_9$ when the higher-order three bits of each of the loaded eight-bit data are outputted, the scanning point reaches the boundary of the sections on the display screen. At this time $t_9$, the same processing as that performed at the time $t_6$ is carried out.

Thus, when the cursor 24 is displayed at such a position that the left-hand edge thereof does not coincide with any one of the boundaries of the display sections, the data remaining in the parallel-to-serial converters 16 and 17 at the time when the scanning point reaches one of the boundaries are held therein until the time when the remaining data should begin to be outputted.

Thus, designation of the coordinates of the cursor 24 can be made in the same manner as that for the CRT display device 11*a*, wherein the display blocks A and B are deemed as constituting one display screen. This is true with the case where the cursor 24 is displayed on the display block B and with the case where a part and the remaining part of the cursor 24 are displayed respectively on the display blocks A and B.

Although in the above embodiment the display screen of the liquid crystal display device 11*b* is composed of two display blocks A and B, this is not exclusive and a liquid crystal display device can have three or more display blocks. In such a case, the number of bits of the signal UD is increased so that each of the display blocks for which display data must be formed can be designated. Also the display controller is modified so that a certain value determined in accordance with the display block currently used is added to the count output V.

The present invention is advantageous in the following respects:

The coordinates of the cursor can be designated even when a liquid crystal display device having a display screen composed of a plurality of display blocks is used, because the display areas of these display blocks can be treated as constituting in combination a continuous single display screen. Thus, the cursor position can be designated in the same way as that for a CRT display device. In addition, any desired pattern of the cursor can be obtained by a suitable rewriting of the data in the cursor pattern memories. Moreover, the cursor can be displayed at any desired position, by virtue of the holding function of the parallel-to-serial converters.

What is claimed is:

1. A display controller for use with either one of a first display device of a type having a single scanning-type display screen to provide a plurality of display dots thereon or a second display device of a type having a plurality of scanning-type display screens arranged in a direction perpendicular to a direction of scanning thereof to form a single screen for providing a plurality of display dots thereon, the display controller alternately effecting scanning among portions of the plurality of screens of the second dispaly device substantially in parallel, said display controller comprising:

display device designating means for designating a type of display device to be used, said type of display device being one of the first display device type or the second display device type, said display device designating means outputting a first designation signal to designate the first display device type and outputting a second designation signal to designate the second display device type;

clock signal generating means for generating a first clock signal synchronized with a scanning of the display screen of the first display device in response to said first designation signal, and for generating a second clock signal synchronized with a scanning of the plurality of display screens of the second display device in response to said second designation signal;

display screen selecting means, rseponsive to said second designation signal, for alternately selecting, in a time-sharing manner such that portions of each of said plurality of display screens are alternately selected, among the plurality of display screens in accordance with said second clock signal and outputting a data forming timing signal indicative of said each selected display screen;

display data forming means, responsive to said first designation signal, for forming a plurality of display data, each representing a dot image of a respective one of the plurality of display dots provided on the display screen of the first display device in accordance with said first clock signal, said display data forming means also being responsive to said second designation signal to alternately form display data representing a dot image of a respective one of the plurality of display dots provided on the display screen of said second display device in a time-sharing manner such that portions of different display data are alternately formed, and in accordance with said second clock signal and said data forming timing signal;

data feeding means, responsive to said first desgination signal and coupled to said display data forming means, for feeding said dispaly data to said first display device;

data separating means, responsive to said second desgination signal and coupled to said display data forming means, for separating said dispaly data formed by said display data forming means into a plurality of groups of data, each group corresponding to a respective one of said plurality of screens of said second dispaly device, and for feeding said plurality of groups of data to said second display device substantially in parallel;

pattern memory means for storing a bit-pattern data, representative of a cursor, in the form of a dot-matrix;

first and second register means for storing first position data representative of a horizontal display position of a dot of said cursor, and storing second position data representative of a vertical display position of said dot of said cursor; and cursor pattern signal forming means, responsive to said first designation signal, said first clock signal and said first and second position data, for forming a first cursor pattern signal from said bit-pattern data, having a timing such that said cursor is displayed on the display screen of said first display device at a position determined by said first and second display positions, said cursor pattern signal forming means also being responsive to said second designation signal, said second clock signal, said data forming timing signal and said first and second position data to form a second cursor pattern signal from said bit-pattern data;

said display data forming means including means for forming said display data in accordance with said first cursor pattern signal in response to said first designation signal, to thereby display said cursor on said display screen of said first display device at said position determined by said horizontal and vertical display positions, and means for forming said display data in accordance with said second cursor pattern signal in response to said second desgination signal to thereby display said cursor on said display screen of said second display device at said position determined by said horizotnal and vertical display positions.

2. A display controller according to claim 1, wherein said cursor pattern signal forming means comprises:

first position data generating means, responsive to said first designation signal, for generating first scanning position data representative of a current horizontal scanning position on the display screen of said first display device in accordance with said first clock signal, said first position data generating means also being responsive to said second designation signal to generate data representative of current horizontal scanning positions on the plurality of display screens of said second display device as said first scanning position data in accordance with said second clock signal;

second position data generating means, responsive to said first desgination signal, for generating second scanning position data representative of a current vertical scanning position on the display screen of said first display device in accordance with said first clock signal, said second position data generating means also being responsive to said second designation signal to generate data representative of current vertical scanning positions on the plurality of display screens of said second display device as said second scanning position data in accordance with said second clock signal;

adder means, responsive to said second designation signal and said display timing signal, for adding values determined in accordance with said data forming timing signal to said second scanning position data, to output third scanning position data, said adder means being responsive to said first designation signal to output said second scanning position data as said third scanning position data;

enabling signal generating means for generating an enabling signal during a time when a difference between said second position data and said third scanning position data is within a predetermined range; and parallel-to-serial converter means, responsive to said enabling signal, for converting said bit-pattern data into a serial form to produce a serial signal, said serial signal being said first cursor pattern signal when said first designation signal is generated and being said second cursor pattern signal when said second designation signal is generated.

3. A display controller according to claim 2, wherein said cursor pattern signal forming means further comprises:

comparator measn for comparing said first scanning position data with said first position data to output a coincidence signal when said first scanning position data and said first position data are within a predetermined range of one another; and reading means for sequentially reading said bit-pattern data from said pattern memory means by groups of a predetermined number of bits at a time, in accordance with said difference between said second position data and said third scanning position data;

and wherein said parallel-to-serial converter means comprises shift register means responsive to said enabling signal and responsive to each of said coincidence signals for loading said group of bits of said bit-pattern data read from said pattern memmory means thereon, for shifting out said loaded bits therefrom in accordance with said clock signal as said cursor pattern signal when said enabling signal is generated, and for holding said loaded bits in the absence of said enabling signal.

4. A display controller according to claim 3, wherein said shift rgister means comprises:

a shift register, responsive to said enabling signal and each of said coincidence signals, for loading said group of bits of said bit-pattern data read from said pattern memory means thereon and for shifting said loaded bits in accordance with said clock signal;

first gate circuit means for outputting said bits shifted out of said shift register as said cursor pattern signal when said enabling signal is generated; and second gate circuit means for feeding said bits shifted out of said shift register back to said shift register when said enabling signal is not generated.

* * * * *